US011219349B2

(12) United States Patent
Haegermarck

(10) Patent No.: US 11,219,349 B2
(45) Date of Patent: Jan. 11, 2022

(54) WASH ARM ASSEMBLY AND DISHWASHER COMPRISING WASH ARM ASSEMBLY

(71) Applicant: ELECTROLUX APPLIANCES AKTIEBOLAG, Stockholm (SE)

(72) Inventor: Anders Haegermarck, Trångsund (SE)

(73) Assignee: Electrolux Appliances Aktiebolag

( * ) Notice: Subject to any disclaimer, the term of this patent is extended or adjusted under 35 U.S.C. 154(b) by 96 days.

(21) Appl. No.: 16/314,789

(22) PCT Filed: Jul. 8, 2016

(86) PCT No.: PCT/EP2016/066289
§ 371 (c)(1),
(2) Date: Jan. 2, 2019

(87) PCT Pub. No.: WO2018/006976
PCT Pub. Date: Jan. 11, 2018

(65) Prior Publication Data

US 2019/0335973 A1 Nov. 7, 2019

(51) Int. Cl.
*A47L 15/23* (2006.01)
*A47L 15/42* (2006.01)

(52) U.S. Cl.
CPC ..... *A47L 15/23* (2013.01); *A47L 15/4217* (2013.01)

(58) Field of Classification Search
CPC .. A47L 15/23; A47L 15/4217; A47L 15/4214; A47L 15/00–508
See application file for complete search history.

(56) References Cited

U.S. PATENT DOCUMENTS 2,013,387 A 9/1935 Johnston
3,267,944 A 8/1966 Meeker et al.
(Continued)

FOREIGN PATENT DOCUMENTS

CH 564937 A 8/1975
CN 202069558 U * 12/2011
(Continued)

OTHER PUBLICATIONS

International Search Report and Written Opinion for Application No. PCT/EP2016/066289 dated Aug. 26, 2016, 10 pages.
(Continued)

*Primary Examiner* — Spencer E. Bell
*Assistant Examiner* — Omair Chaudhri
(74) *Attorney, Agent, or Firm* — RatnerPrestia

(57) ABSTRACT

A wash arm assembly may include: a wash arm having a circular opening with a center, an edge, and a mounting unit having a circular insertion portion and a supporting portion. The mounting unit may be inserted at least partly in the circular opening to mount the wash arm within the dishwasher and to allow rotation of the wash arm around a rotational axis. The insertion portion may be inserted at least partly in the circular opening to form a passage between the edge and the circular insertion portion when the mounting unit is inserted at least partly in the circular opening. The wash arm may include a protrusion, and the supporting portion and the wash arm may form a chamber delimited by the passage and the protrusion when the supporting portion supports the wash arm. A dishwasher including the wash arm assembly may also be provided.

12 Claims, 4 Drawing Sheets

(56) References Cited

U.S. PATENT DOCUMENTS

| | | | | |
|---|---|---|---|---|
| 3,918,644 | A | 11/1975 | Platt et al. | |
| 4,869,428 | A | 9/1989 | Gombar | |
| 5,211,190 | A | 5/1993 | Johnson et al. | |
| 5,433,228 | A * | 7/1995 | Dingler | A47L 15/0057 134/104.1 |
| 5,623,956 | A | 4/1997 | Kirkland | |
| 5,662,744 | A | 9/1997 | Tuller et al. | |
| 5,673,716 | A | 10/1997 | Gurubatham et al. | |
| 5,752,533 | A | 5/1998 | Edwards | |
| 5,904,166 | A | 5/1999 | Nannt et al. | |
| 6,959,881 | B2 | 11/2005 | Kim | |
| 9,314,144 | B2 | 4/2016 | Bayer et al. | |
| 9,427,132 | B2 | 8/2016 | Boyer et al. | |
| 2005/0241681 | A1 | 11/2005 | Hwang | |
| 2012/0037193 | A1* | 2/2012 | Bayer | A47L 15/23 134/180 |
| 2012/0279534 | A1* | 11/2012 | Boyer | A47L 15/23 134/198 |
| 2013/0206179 | A1 | 8/2013 | Watson et al. | |
| 2014/0190534 | A1* | 7/2014 | Boyer | A47L 15/23 134/198 |
| 2016/0324392 | A1 | 11/2016 | Xu et al. | |
| 2016/0324393 | A1 | 11/2016 | Xu et al. | |
| 2017/0354308 | A1* | 12/2017 | Choi | A47L 15/23 |
| 2017/0354312 | A1* | 12/2017 | Woo | A47L 15/4282 |

FOREIGN PATENT DOCUMENTS

| | | | | |
|---|---|---|---|---|
| CN | 202069558 | U | 12/2011 | |
| DE | 3702828 | C1 | 4/1988 | |
| DE | 4004319 | A1 | 8/1991 | |
| DE | 9211182 | U1 | 12/1993 | |
| DE | 19812329 | C1 | 6/1999 | |
| DE | 10 2010 043021 | A1 | 5/2012 | |
| EP | 2 215 952 | A1 | 8/2010 | |
| EP | 2 556 781 | A1 | 2/2013 | |
| EP | 2556781 | A1 * | 2/2013 | A47L 15/23 |
| KR | 101054221 | B1 | 11/2005 | |
| KR | 101598753 | B | 2/2016 | |
| KR | 101598753 | B1 * | 2/2016 | |
| WO | WO 2010/089149 | | 8/2010 | |
| WO | WO 2018/006976 | A1 | 1/2018 | |

OTHER PUBLICATIONS

Office Action for Russian Application No. 2019109952 dated Dec. 13, 2019.

* cited by examiner

WASH ARM ASSEMBLY AND DISHWASHER COMPRISING WASH ARM ASSEMBLY

CROSS-REFERENCE TO RELATED APPLICATIONS

This application is a national stage application filed under 35 U.S.C. § 371 of International Application No. PCT/EP2016/066289 filed Jul. 8, 2016, which application is hereby incorporated by reference herein in its entirety.

TECHNICAL FIELD

Embodiments herein relate to a wash arm assembly for a dishwasher and a dishwasher comprising the wash arm assembly.

BACKGROUND

Today's dishwashers are expected to perform high quality wash of dishware while at the same time to efficiently use of water and energy in order to fulfill requirements concerning environmental impact and sustainability. Various arrangements, taking up some space within the dishwashers, for washing of the dishware in an efficient manner have thus been developed. However, it is also desired that the dishwashers can accommodate a lot of dishware to be washed. Therefore, it is desired that space within the dishwashers for accommodating dishware is as large as possible. A trade-off between space for dishware and environmental impact is consequently made.

A known dishwasher comprises a so called upper wash arm connection as one typical example of the aforementioned arrangements for washing of dishware. The upper wash arm connection usually connects an upper wash arm to a tube for providing washing liquid to be exerted out of the upper wash arm. A bearing, or a bearing-like arrangement, is thus formed when the upper wash arm is connected to the tube. It is desired that the upper wash arm connection has a low profile to limit space occupied by it within the dishwasher. Furthermore, leakage of the washing liquid through the bearing is desired, since the leakage creates lift forces within the bearing and lubricates the bearing. In this manner, friction within the bearing is reduced. However, the leakage is desired to be limited due to that the leakage reduces an amount of water, efficiently expelled out of the upper wash arm, for providing high quality wash. The bearing should preferably also be characterized by low friction, low sensitivity and/or susceptibility to dirt and high abrasive resistance.

WO2010089149 discloses a spray arm assembly comprising a support means with a mounting element for mounting of the support means within a dishwasher. The support means comprises a support member for supporting the spray arm. During use of the dishwasher and during rotation of the spray arm, the spray arm floats on a liquid layer formed between the spray arm and the support member due to a leakage therebetween. During use of the dishwasher, pressure of the liquid may vary. Variation of the pressure causes the leakage to vary as well. As a consequence thereof, rotation of the spray arm may become unstable.

A problem with the spray arm assembly of WO2010089149 is hence that the rotation of the spray arm may become unstable when pressure of the liquid varies during use of the dishwasher.

SUMMARY

An object of the embodiments herein is to provide a wash arm assembly, comprising a wash arm that provides an improved rotational movement of the wash arm during dynamic operational conditions of the dishwasher.

According to an aspect of the present disclosure, the object is achieved by a wash arm assembly for a dishwasher. The wash arm assembly comprises: a wash arm comprising a circular opening with a centre and with an edge, and a mounting unit comprising a circular insertion portion and a supporting portion extending radially from the circular insertion portion. The mounting unit is arranged to be inserted at least partly in the circular opening to mount the wash arm within the dishwasher and to allow rotation of the wash arm around a rotational axis of the wash arm. Thus, the wash arm may be mounted, i.e. installed within the dishwasher, simply by at least partial insertion of the mounting unit into the circular opening.

The circular insertion portion is arranged to be inserted at least partly in the circular opening to form a passage between the edge and the circular insertion portion when the mounting unit is inserted at least partly in the circular opening. Thereby, the circular insertion portion may be easily inserted in the circular opening thanks to the passage, e.g. formed by a distance between the circular insertion portion and the edge of the circular opening. Further, during different operational conditions of the dishwasher, a washing liquid may easily flow through the passage between the edge and the circular insertion portion. Thus, the wash arm assembly allows the washing liquid to flow between the circular insertion portion and the edge during operation of the dishwasher. The supporting portion is arranged to support the wash arm when the circular insertion portion is inserted at least partly in the circular opening. In other words, the wash arm is held in a predetermined position within the dishwasher by the supporting portion when the circular insertion portion is inserted at least partly in the circular opening. Thus, the wash arm is mounted and held in the predetermined position simply by the mounting unit when the mounting unit is inserted at least partly in the circular opening.

The wash arm comprises a protrusion, protruding parallely to the rotational axis towards the supporting portion when supporting the wash arm. The protrusion extends around the centre. Further, the supporting portion and the wash arm are arranged to form a chamber delimited by the passage and the protrusion when the supporting portion supports the wash arm. The term chamber may refer to a space, or a room, with a volume formed between the wash arm and the supporting portion when the supporting portion supports the wash arm, i.e. when the mounting unit and the insertion portion are at least partly inserted in the circular opening. Thereby, in operation of the dishwasher, the washing liquid is allowed to flow through the passage between the edge and the circular insertion portion into the chamber. Thanks to that the chamber that is delimited by the protrusion, the washing liquid will fill the chamber and remain in the chamber during at least certain operation conditions of the dishwasher. When the chamber is filled by the washing liquid, pressure of the washing liquid in the chamber increases to a certain level. The chamber acts as a pressure regulator. The pressure may then create evenly distributed and centred lift forces acting on the wash arm. The lift forces, acting on the wash arm, may facilitate the rotational movement of the wash arm due to reduced friction between e.g. the protrusion and the supporting portion. Thus, thanks to the chamber, a substantially constant static pressure of the washing liquid in the chamber is achieved, which pressure may remain constant and uniform during different operational conditions of the dishwasher.

In this manner, the improved rotational movement of the wash arm is achieved, e.g. during dynamic operational conditions of the dishwasher.

Consequently, an improved wash arm assembly is obtained.

As a result, the above mentioned object is achieved.

The protrusion may be arranged to abut against the supporting portion in at least a non-operational mode of the wash arm. The non-operational mode of the wash arm refers to when the wash arm is not rotating. For example, the non-operational mode may refer to any point in time before mounting of the wash arm in the dishwasher or before the wash arm has begun to rotate, but after the dishwasher has started, typically as a user of the dishwasher wishes to clean some dishware.

According to some embodiments, a second passage is formed between the protrusion and the supporting portion in an operational mode of the wash arm. The operation mode of the wash arm refers to when the wash arm is driven to a rotational movement e.g. by the washing liquid, i.e. when the washing liquid is delivered to the wash arm with a pressure causing rotation of the wash arm. Further, the second passage is formed when the washing liquid is delivered with a pressure causing lifting of the wash arm in relation to the supporting portion. Since the second passage is formed between the protrusion and the supporting portion in the operational mode of the wash arm the washing liquid may flow through the second passage in a direction out from the chamber to an interior of the dishwasher. Thus, the wash arm may float at least partly on the flow of the washing liquid between the protrusion and the supporting portion which decreases friction during rotation of the wash arm. Thereby an improved rotational movement of the wash arm is achieved. Further, thanks to the above mentioned chamber, acting as a pressure regulator, between the wash arm and the supporting portion during operation of the dishwasher lifting of the wash arm may be controlled. By controlled lift of the wash arm, the flow of the washing liquid through the second passage is regulated during different operational conditions of the dishwasher. As a result, leakage through the wash arm assembly are reduced and friction forces are minimized during dynamic operation of the dishwasher. Thus, an improved wash arm assembly is obtained.

The protrusion may extend along a circle with the centre, i.e. the circle is defined with respect to the center. Thereby, a manufacturing process of the wash arm may be simplified. Further, with the protrusion extending along the circle, the chamber delimited by the passage and the protrusion will have circular shapes which improve a distribution of pressure within the chamber.

According to some embodiments, the protrusion comprises a first guiding surface and the supporting portion comprises a second guiding surface, wherein the first guiding surface is aligned to the second guiding surface when the wash arm is supported by the supporting portion.

As an effect thereof, the protrusion is guided into a predetermined position in relation to the supporting portion when the wash arm is supported by the supporting portion. In other words, the first and second guiding surfaces are arranged to guide, the protrusion into a predetermined position in relation to the supporting portion when the wash arm is supported by the supporting portion. Thus, thanks to the first and second guiding surfaces, the protrusion and thereby the wash arm may easily be positioned in relation to the supporting portion in said predetermined position. Further, the predetermined position may be achieved repeatedly each time the wash arm is supported by the supporting portion thanks to the guiding surfaces of the protrusion and the supporting portion.

The first and second guiding surfaces may be arranged to guide the protrusion and the supporting portion into alignment with each other upon rotation of the wash arm. In this manner, the first and second guiding surfaces are guided such that the first and second guiding surfaces are at least substantially parallel to each other. Thereby, during rotation of the wash arm, the first and second guiding surfaces are all the time guided into alignment with each other even if the first and second guiding surfaces are not completely, or at least substantially, parallel to each other at all times as explained in more detail below.

A disturbance of the wash arm, for example caused by dirt that get stuck in the wash arm assembly or by dynamic operation conditions may lead to wobbling of the wash arm. During the wobbling, the first and second guiding surfaces are displaced from alignment with each other. However, on account said first and second guiding surfaces the wash arm is guided back to the position where the first and second guiding surfaces align with each other. Thereby, wobbling of the wash arm is prevented.

According to some embodiments the supporting portion is arranged to receive at least a first part of the protrusion. Thereby, during rotation of the wash arm, the protrusion may follow a predetermined track relatively the supporting portion. In other words, the wash arm may be guided by the supporting portion during rotation of the wash arm. Thus, a risk of displacement of the wash arm, relatively the supporting portion during rotation of the wash arm, is reduced. As a result, an improved rotational movement of the wash arm is achieved.

The supporting portion may comprise a groove to receive at least a second part of the protrusion. Thereby, risk of he wash arm to be displaced relatively the supporting portion during rotation of the wash arm is further reduced According to some embodiments, the edge has a form of a 'v' pointing towards the circular inserting portion when the circular inserting portion is inserted in the circular opening. Thereby, risk of particle, dirt or the like to get stuck in the passage between the edge and the circular insertion portion is reduced due to a knife-effect of the v-form on the particle in the passage. Thus, in a case of a particle in the passage the particle will be cut by the edge and flushed away by the washing liquid. As an effect, the wash arm assembly is robust.

In some embodiments, the edge has a circular form.

The wash arm may be mounted in an upper position within an interior of the dishwasher.

According to another aspect of the embodiments herein, the object is achieved by a dishwasher comprising a wash arm assembly according to the embodiments herein.

Further features of, and advantages with, the embodiments herein will become apparent when studying the appended claims and the following detailed description. Those skilled in the art will realize that the different features described may be combined to create embodiments other than those described in the following, without departing from the scope of the embodiments herein, as defined by the appended claims.

BRIEF DESCRIPTION OF THE DRAWINGS

The various aspects of the embodiments herein, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout. Well-known functions or constructions will not necessarily be described in detail for brevity and/or clarity.

Figure 1:
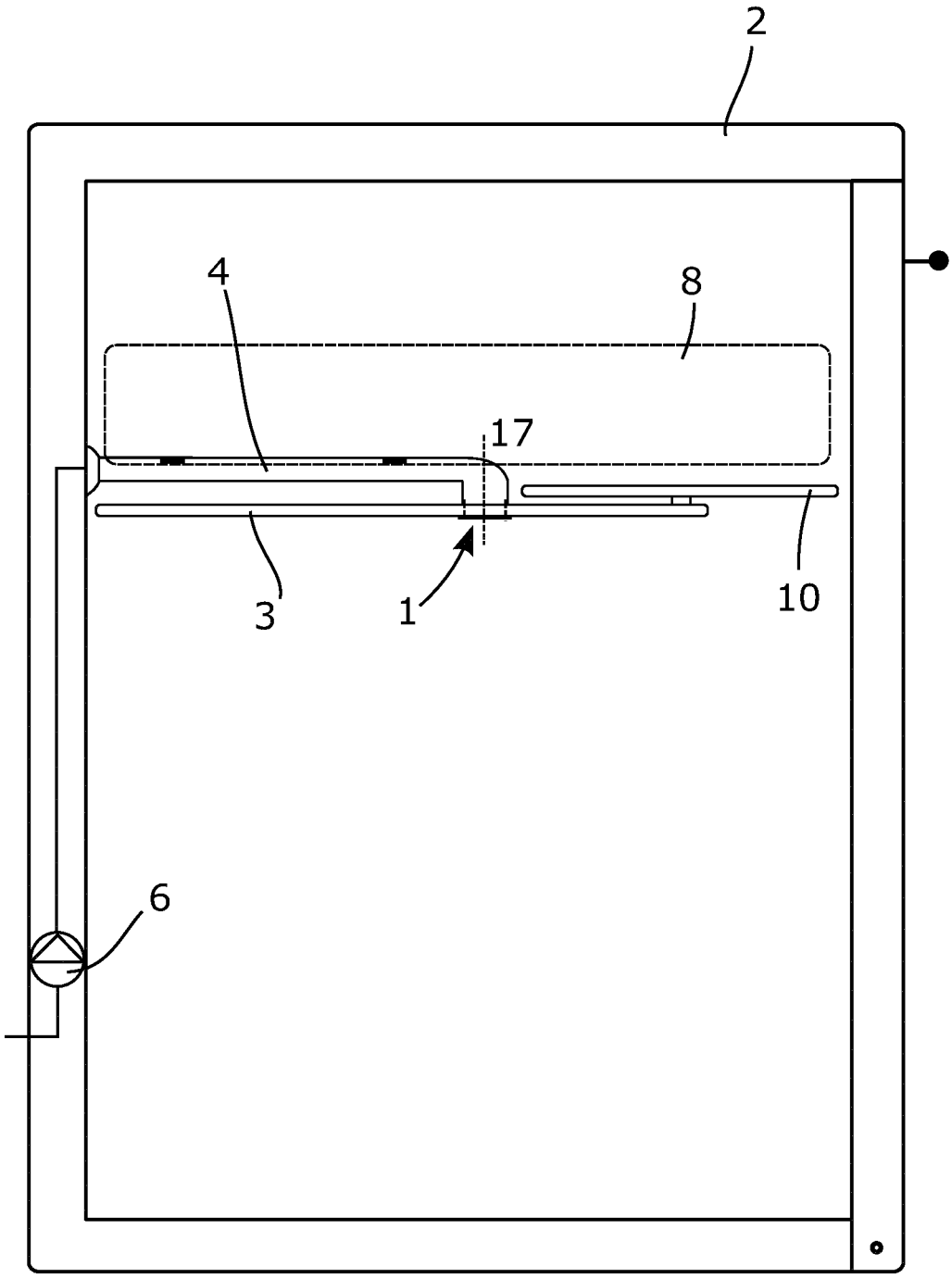
FIG. 1 is a side view illustrating a dishwasher comprising a wash arm assembly.

FIG. 1 illustrates a wash arm assembly 1 arranged within an interior of a dishwasher 2. The dishwasher 2 may thus be said to comprise the wash arm assembly 1. The dishwasher 2 comprises a wash arm 3. The wash arm 3 may comprise an additional wash arm 10, sometimes referred to as a satellite wash arm due to its relation to the wash arm 3, which sometimes may be referred to as a main wash arm. As shown in FIG. 1, the wash arm 3 is rotatably connected to a main tube 4, through which a washing liquid is supplied to the wash arm 3. The wash arm 3 is arranged to rotate around an axis 17. Typically, the main tube 4 is connected to a washing liquid supply line comprising a pump 6 for supplying of the washing liquid to the dishwasher 2. According to the embodiment illustrated in FIG. 1, the wash arm assembly 1 is arranged under a basket 8 for accommodating dishware (not shown) to be washed within the dishwasher 2. In such a position within the dishwasher 2, the wash arm assembly 1 may also be referred to as an upper wash arm assembly. It means that the wash arm assembly is arranged at an upper position within the interior of the dishwasher 2. The upper position shall be understood as "upper" in relation to an ordinary operation of the dishwasher 2.

Figure 2:
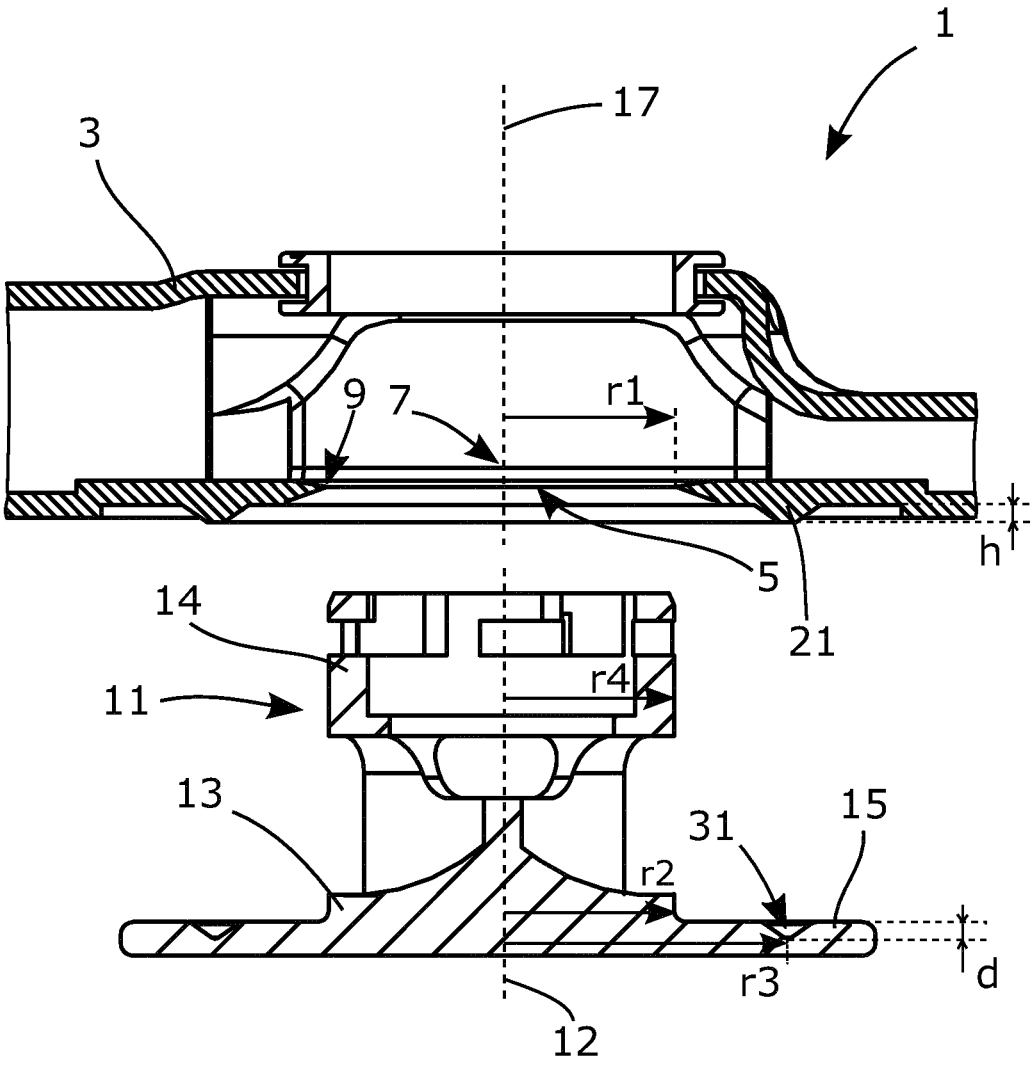
FIG. 2 is a plan view illustrating the wash arm assembly illustrated in FIG. 1, wherein the wash arm assembly is disassembled.

FIG. 2 illustrates a more detailed side-view of the wash arm assembly 1 shown in FIG. 1. The wash arm assembly 1 is arranged for assembling the wash arm 3 in the dishwasher 2. In other words, the wash arm assembly 1 is arranged for mounting of the wash arm 3 within the dishwasher.

The wash arm assembly 1 comprises a wash arm 3, comprising a circular opening 5. The circular opening 5 has, or is provided with, a centre 7 and an edge 9. The wash arm assembly 1 further comprises a mounting unit 11, comprising a circular insertion portion 13 and a supporting portion 15. The supporting portion 15 extends radially from the circular insertion portion 13. As can be seen in FIG. 2, the circular opening 5 has a first radius r1, the circular insertion portion has a second radius r2 relatively a mounting axis 12 of the mounting unit 11 and the supporting portion 15 has a third radius r3 relatively the mounting axis 12. Moreover, the supporting portion 15 extends radially from the circular insertion portion 13 in relation to the mounting axis 12. The supporting portion 15 may extend radially and equally i.e. with the same third radius r3 from the circular insertion portion 13 and thereby may have a form of a circle with the third radius r3. However, the supporting portion 15 may extend radially and unequally i.e. with different radius from the circular insertion portion 13 and thereby may have a form of for example a square, oval, rectangle or the like.

The mounting unit 11 further comprises a connection portion 14. The connection portion 14 may be circular with a fourth radius r4 relatively the mounting axis 12. The mounting unit 11 is arranged to be inserted at least partly into the circular opening 5 to mount the wash arm 3 within the dishwasher. According to the embodiments in FIG. 2, the fourth radius r4 of the connection portion 14 is less than the first radius r1 of the circular opening 5 to enable insertion of the connection portion 14 in the circular opening 5 in order to connect the connection portion 14 to the main tube 4 illustrated in FIG. 1. The connection portion 14 is arranged to be connected to the main tube 4 in a common manner and therefore not described in detail herein. Clearance between the first radius r1 and the fourth radius r4 may be in a range of 1-3 mm.

The second radius r2 of the insertion portion 13 may be less than the first radius r1. Thereby, the insertion portion 13 may be inserted at least partly in the circular opening 5. Clearance between the first radius r1 and the second radius r2 may preferably be less than 1 mm.

The third radius r3 of the supporting portion 15 is larger than the first radius r1. Thereby, when the mounting unit 11 is at least partly inserted in the circular opening 5, the supporting portion 15 extends over the circular opening 5 and supports the wash arm 3. In this way, the wash arm 3 may be mounted within the dishwasher 2. The supporting portion 15 supporting i.e. holding the wash arm 3 is illustrated in FIG. 2. The third radius r3 may be 5-10 mm greater than the first radius r1. According to some embodiments the second radius r2 and the fourth r4 are essentially equal an lifting forces acting on the wash arm 3 mostly dependent on the difference between the fourth radius r4 and the third radius r3. Thus, the bigger difference the higher lift forces in the wash arm 3.

The wash arm 3 comprises a protrusion 21, protruding parallely to the rotational axis 17 and towards the supporting portion 15 when the supporting portion 15 supports the wash arm 3. The term protrusion 21 refers to a part of the wash arm 3 with a greater thickness than the rest of the wash arm 3. In other words the wash arm comprises a part of the wash arm 3 that stand out from the wash arm. According to some embodiments, a cross-section of the protrusion 21 comprises a v-shape, where a tip of the v-shape points out from the wash arm 3 parallely to the rotational axis 17. The cross-section is taken along a plane that is parallel to the rotational axis 17 and that runs through the rotational axis 17. The v-shape may, alternatively or additionally, comprise a circular shape, a square shape or the like. The protrusion 21 may have a height h which may be in a range of 2-5 mm.

The protrusion 21 extends around the centre 7 of the circular opening 5. In other words, the protrusion 21 extends continuously as a uniform body without interruption around the centre 7. According to some embodiments, the protrusion 21 may extend along a circle defined with respect to said centre 7.

Figure 3:
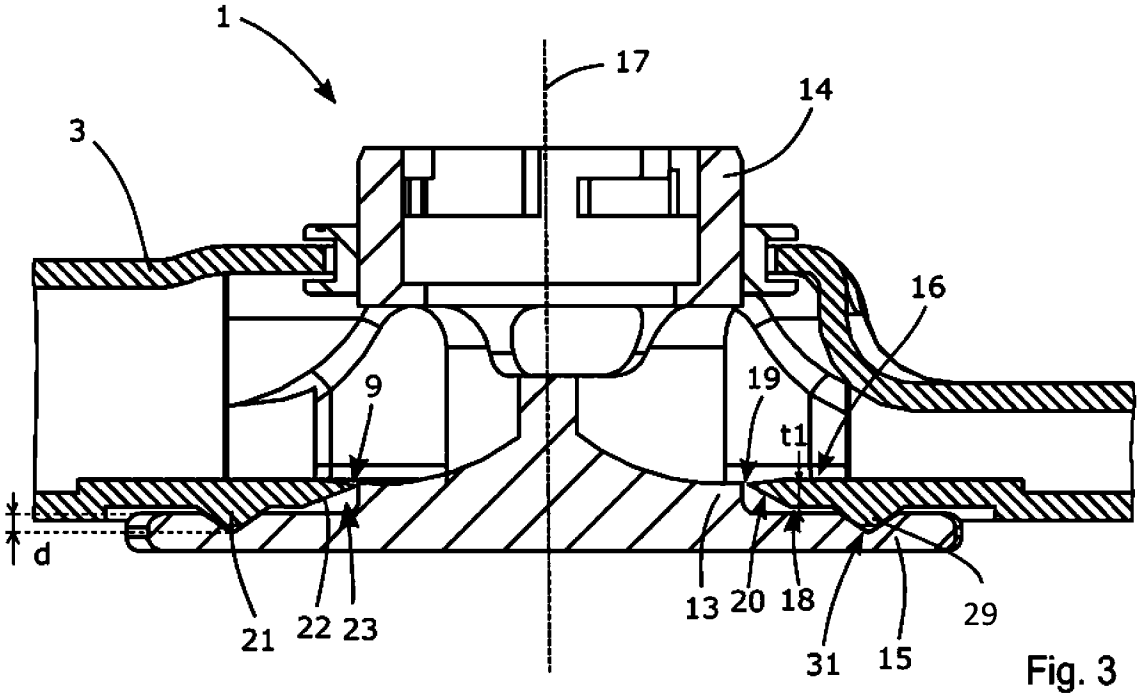
FIG. 3 is another plan view illustrating the wash arm assembly illustrated in FIG. 1, wherein the wash arm assembly is assembled.

FIG. 3 shows the wash arm assembly 1 illustrated in FIG. 2. The mounting unit 11 is at least partly inserted into the circular opening 5, whereby the supporting portion 15 supports the wash arm 3. The mounting unit 11 is arranged to be at least partly inserted in the circular opening 5 to allow rotation of the wash arm 3 around the rotational axis 17 of the wash arm 3. According to some embodiments, the mounting axis 12 described above may coincide with the rotational axis 17 of the wash arm when the mounting unit is at least partly inserted in the circular opening 5.

As can be seen in the FIG. 3, a passage 19 between the edge 9 and the circular insertion portion 13 is formed when the mounting unit 11 is inserted at least partly in the circular opening 5. Further, the supporting portion 15 and the wash arm 3 are arranged to form a chamber 23 delimited by the passage 19 and the protrusion 21 when the supporting portion 15 supports the wash arm 3. Thus, during different operational conditions of the dishwasher, the washing liquid may easily flow through the passage 19 between the edge 9 and the circular insertion portion 13. The term chamber 23 may refer to a space, a room with a volume formed between the wash arm 3 and the supporting portion 15 when the supporting portion supports 15 the wash arm 3, i.e. when the mounting unit 11 and the insertion portion 13 are at least partly inserted in the circular opening 5. As illustrated in FIG. 3, the wash arm 3 comprises an edge portion 16, comprising the edge 9. The edge portion 16 comprises a first sub-portion 18 with a first thickness t1 and a second sub-portion 20 thinning out in a direction towards the edge 9. According to some embodiments, said chamber 23 is formed between the first sub-portion 18 and the supporting portion 15 when the supporting portion 15 supports the wash arm 3. The first sub-portion 18 may be formed by beveling the first sub-portion 18 along a surface 22 in a direction from the second sub-portion 20 towards the edge 9. Thus, the surface 22 may be essentially straight and inclined towards said edge 9. However, the surface 22, when seen in cross-section perspective, may for example have a circular form or a form of a square or the like.

The wash arm assembly 1 illustrated in FIG. 3 corresponds to a non-operational mode of the wash arm 3. With the non-operational mode is meant when the wash arm 3 is not driven to a rotational movement by the washing liquid. For example before mounting of the wash arm 3 in the dishwasher or before the washing liquid is delivered with sufficient pressure to achieve rotation of the wash arm 3. In at least the non-operational mode, the protrusion 21 may abut, i.e. have contact with the supporting portion 15.

According to some embodiments, the supporting portion 15 comprises a groove 31 arranged to receive at least a part 29 of the protrusion 21. The groove 31 enables, such as supports, facilities and the like, positioning of the protrusion 21 and thereby also positioning of the wash arm 3 within the wash arm assembly 1. Moreover, the groove 31 supports guiding of the wash arm 3 during rotation of the wash arm 3. According to some embodiments, a cross-section of the groove 31 by a plane parallel to the mounting axis 12 and through the mounting axis 12 has form corresponding to the form of the protrusion 21. The cross-section of the groove 31 may than have form of a v or a circular form or square or the like.

Figure 4:
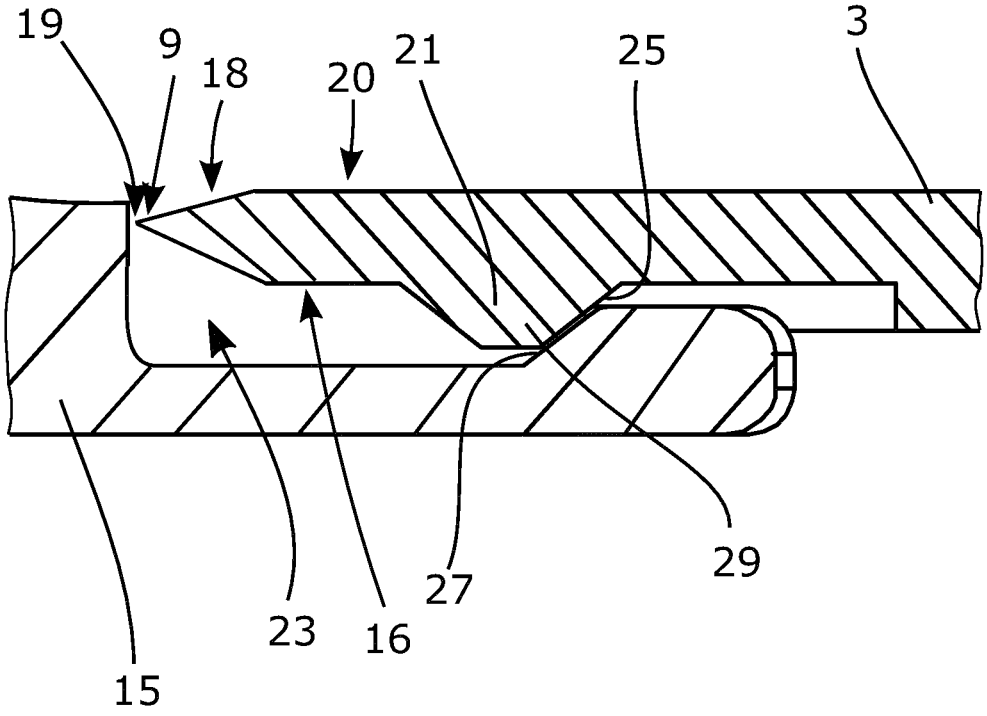
FIG. 4 is a further plan view illustrating an embodiment of the wash arm assembly.

According to FIG. 4, the chamber 23 is formed by both the first sub-portion 18 and by the second sub-portion 20 of the edge portion of the wash arm 3 and by the supporting portion 15 when supporting the wash arm 3. As shown in the FIG. 4, the supporting portion 15 is arranged to receive at least a part 29 of the protrusion 21. As shown in FIGS. 3 and 4, the at least a part 29 may not be the same in all instances.

The protrusion 21 may comprise a first guiding surface 25 and the supporting portion 15 may comprise a second guiding surface 27. The first guiding surface 25 is aligned to the second guiding surface 27 when the wash arm 3 is supported by the supporting portion 15. The first and second guiding surfaces 25, 27 are arranged to guide the protrusion 21 and the supporting portion 15 into alignment with each other upon rotation of the wash arm 3. In this manner, the first and second guiding surfaces 25, 27 are guided such that the first and second guiding surfaces 25, 27 are at least substantially parallel to each other. Thereby, during rotation of the wash arm 3, the first and second guiding surfaces 25, 27 are all the time guided into alignment with each other even if the first and second guiding surfaces 25, 27 are not completely, or at least substantially, parallel to each other at all times, for example during a disturbance. The disturbance may, for example be caused by dirt that get stuck in the wash arm assembly or by dynamic operation conditions of the dishwasher.

The edge 9 may have a form of a v pointing towards the circular inserting portion 11 when the circular inserting portion 11 is inserted in the circular opening 5 or the edge 9 may have a circular form. When the edge 9 has a form of a v the edge 9 may act as a knife cutting any dirt or particles getting between the edge 9 and the circular insertion portion.

The invention claimed is:

1. A wash arm assembly for a dishwasher, comprising:

a wash arm comprising a circular opening with a centre and with an edge portion comprising an edge; and a mounting unit comprising a circular insertion portion and a supporting portion extending radially from said circular insertion portion, wherein said mounting unit is arranged to be inserted at least partly in said circular opening to mount said wash arm within said dishwasher and to allow rotation of said wash arm around a rotational axis of said wash arm, wherein said circular insertion portion is arranged to be inserted at least partly in said circular opening to form a passage between said edge and said circular insertion portion when said mounting unit is inserted at least partly in said circular opening, wherein said supporting portion is arranged to support said wash arm when said circular insertion portion is inserted at least partly in said circular opening, wherein said wash arm comprises a protrusion, protruding parallely to said rotational axis towards said supporting portion extending around said centre, and wherein said supporting portion and said wash arm are arranged to form a chamber delimited by said edge portion including said edge, said supporting portion, said passage, and said protrusion when said supporting portion supports said wash arm, wherein said edge has a form of a v, and wherein the edge is configured to point towards said circular inserting portion when said circular inserting portion is inserted in said circular opening.

2. The wash arm assembly according to claim 1, wherein said protrusion is arranged to abut against said supporting portion in at least a non-operational mode of said wash arm.

3. The wash arm assembly according to claim 1, wherein a second passage is formed between said protrusion and said supporting portion in an operational mode of said wash arm.

4. The wash arm assembly according to claim 1, wherein said protrusion extends along a circle with said centre, wherein the protrusion comprises a first guiding surface and said supporting portion comprises a second guiding surface, wherein said first guiding surface is aligned to said second guiding surface when said wash arm is supported by said supporting portion, and wherein said first and second guiding surfaces are arranged to guide said protrusion and said supporting portion into alignment with each other upon rotation of the wash arm.

5. The wash arm assembly according to claim 1, wherein said supporting portion is arranged to receive at least a part of the protrusion.

6. The wash arm assembly according to claim 5, wherein said supporting portion comprises a groove to receive the at least the part of said protrusion.

7. The wash assembly according to claim 1, wherein said wash arm is mounted in an upper position within an interior of said dishwasher.

8. A dishwasher comprising a wash arm assembly according to claim 1.

9. The wash assembly according to claim 1, wherein the protrusion is defined farther from the rotational axis than the edge of the wash arm.

10. The wash assembly according to claim 1, wherein at least a portion of the edge portion is defined between the edge and the protrusion along the wash arm.

11. A wash arm assembly for a dishwasher, comprising:

a wash arm comprising a circular opening with a centre and with an edge portion comprising an edge; and a mounting unit comprising a circular insertion portion and a supporting portion extending radially from said circular insertion portion, wherein said mounting unit is arranged to be inserted at least partly in said circular opening to mount said wash arm within said dishwasher and to allow rotation of said wash arm around a rotational axis of said wash arm, wherein said circular insertion portion is arranged to be inserted at least partly in said circular opening to form a passage between said edge and said circular insertion portion when said mounting unit is inserted at least partly in said circular opening, wherein said supporting portion is arranged to support said wash arm when said circular insertion portion is inserted at least partly in said circular opening, wherein said wash arm comprises a v-shaped protrusion, protruding parallely to said rotational axis towards said supporting portion extending around said centre, wherein said supporting portion and said wash arm are arranged to form a chamber delimited by said edge portion, said supporting portion, said passage, and said v-shaped protrusion when said supporting portion supports said wash arm, wherein said supporting portion is arranged to receive at least a part of the v-shaped protrusion, and wherein said supporting portion comprises a v-shaped groove to receive and contact the at least the part of said v-shaped protrusion, the v-shaped groove defining a recessed portion with radially inward and outward sides of the groove being higher than the recessed portion, the contact between the v-shaped groove and the v-shaped protrusion guiding the rotation of the wash arm around the rotational axis of the wash arm.

12. A wash arm assembly for a dishwasher, comprising:

a wash arm comprising a circular opening with a centre and with an edge portion comprising an edge; and a mounting unit comprising a circular insertion portion and a supporting portion extending radially from said circular insertion portion, wherein said mounting unit is arranged to be inserted at least partly in said circular opening to mount said wash arm within said dishwasher and to allow rotation of said wash arm around a rotational axis of said wash arm, wherein said circular insertion portion is arranged to be inserted at least partly in said circular opening to form a passage between said edge and said circular insertion portion when said mounting unit is inserted at least partly in said circular opening, wherein said supporting portion is arranged to support said wash arm when said circular insertion portion is inserted at least partly in said circular opening, wherein said wash arm comprises a raised ledge, wherein the raised ledge comprises a protrusion and the edge, the protrusion protruding parallely to said rotational axis towards said supporting portion extending around said centre, and wherein said supporting portion and said wash arm are arranged to form a chamber delimited by said edge portion including said edge, said supporting portion, said passage, and said protrusion when said supporting portion supports said wash arm.

* * * * *